United States Patent [19]

Chamberlain

[11] Patent Number: 4,913,668

[45] Date of Patent: Apr. 3, 1990

[54] BATTERY CLAMP

[76] Inventor: Lisa D. Chamberlain, 3157 Portis, St. Louis, Mo. 63116

[21] Appl. No.: 336,111

[22] Filed: Apr. 11, 1989

[51] Int. Cl.[4] ..... H01R 11/26

[52] U.S. Cl. ..... 439/755; 439/751; 81/125.1; 7/139

[58] Field of Search ..... 439/754–756, 439/759; 81/125.1; 7/100, 107, 139, 168

[56] References Cited

U.S. PATENT DOCUMENTS

| | | | |
|---|---|---|---|
| 3,259,754 | 6/1966 | Matheson | 439/504 |
| 3,267,452 | 8/1966 | Wolf | 439/506 |
| 3,337,695 | 8/1967 | Brown | 439/503 |
| 3,936,121 | 2/1976 | Leinberger | 439/506 |
| 4,431,925 | 2/1984 | Frisbee | 439/504 |
| 4,449,772 | 5/1984 | Johnson, III | 439/504 |
| 4,496,204 | 1/1985 | Conley | 439/504 |
| 4,620,767 | 11/1986 | Woolf | 439/755 |
| 4,636,025 | 1/1987 | Norris | 439/755 |

FOREIGN PATENT DOCUMENTS

| | | | |
|---|---|---|---|
| 567843 | 10/1924 | France | 7/139 |

*Primary Examiner*—P. Austin Bradley
*Attorney, Agent, or Firm*—Andsel Group

[57] ABSTRACT

A spring loaded battery clamp having two linear sets of jaws on the front end. The first set of jaws at the end of the battery clamp configured to grasp the square or hex head battery terminal. The second set of jaws configured to compressively grasp the battery terminal. The two arms of the battery clamp pivotably connected by a hinge pin with an associated return spring tending to keep the jaws together. One of the battery clamp arms extending back of the hinge point terminating in an end wrench. The other arm terminating in an electrical cable fastening means.

1 Claim, 1 Drawing Sheet

BATTERY CLAMP

BACKGROUND OF THE INVENTION

1. Field of the Invention

This invention relates to battery clamps specifically a battery clamp having a built-in adjustable end wrench and two sets of jaws of different sizes. The additional tools incorporated in the battery clamp simplify the installation or removal of the clamp.

2. Description of the Prior Art

A search of the prior art in the U.S. Patent office files did not reveal a battery clamp of similar design. U.S. Pat. No. 4,449,772 Johnson III 1984 discloses a battery clamp having two sets of jaws. A set of jaws is incorporated on each end of the battery clamp.

SUMMARY OF THE INVENTION

The battery clamp described in the instant invention incorporates two sets of matching jaws rotatable around a hinge pivot. The jaws at the terminal end of the clamp having a grasping radius compatible with the compression bolts on a standard battery terminal clamp. The adjacent jaws having a grasping radius compatible with the battery terminal. On the outside surface of the battery clamp, opposite the jaws, is mounted a circular clamp fitting having a tapered, corrugated center orifice. The tapered inside diameter conforming to the terminal post on the battery. The two handle portions of the battery clamp extending rearwards from the hinge an adjustable end wrench attached to the first handle with the second handle terminating in an electrical cable fastening means. A coil spring aroung the hinge pivot pin urges the jaws into the closed position.

DETAILED DESCRIPTION OF THE PREFERRED EMBODIMENT

Figure 1:
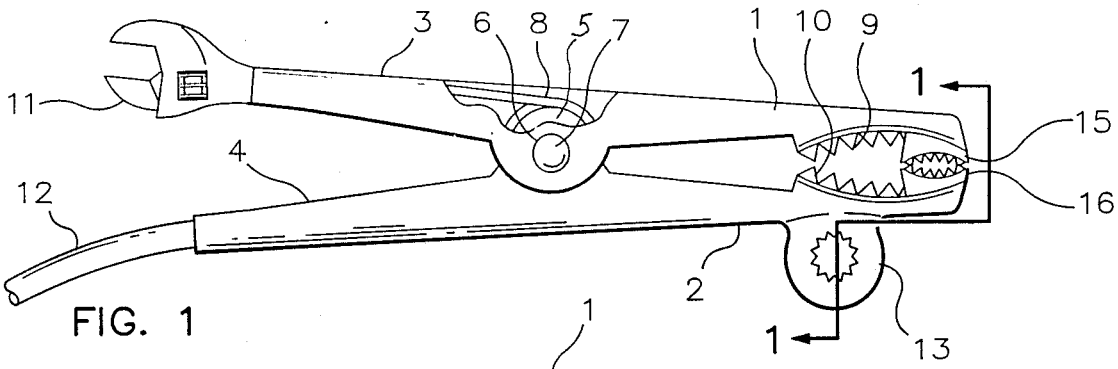
FIG. 1 is a plan view of the battery clamp.
Figure 2:
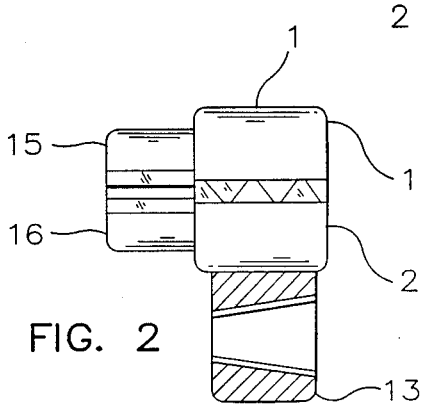
FIG. 2 is a sectional view through 1—1 of FIG. 1.
Figure 3:
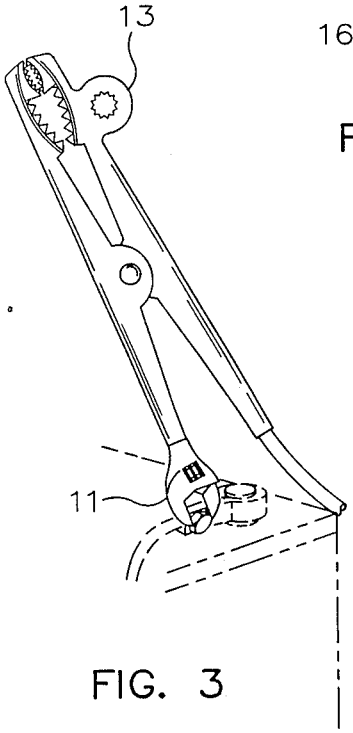
FIG. 3 shows the application of the adjustable end wrench.
Figure 4:
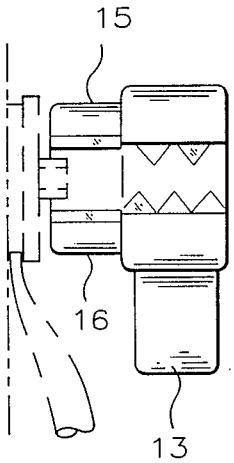
FIG. 4 shows the application of the terminal set of jaws of the battery clamp.
Figure 5:
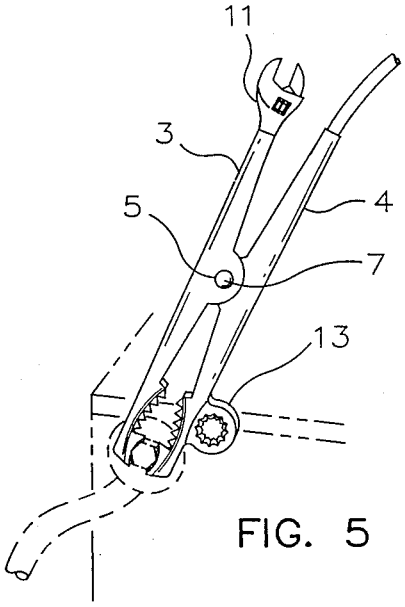
FIG. 5 shows the application of the smaller radius jaws grasping a terminal bolt.
Figure 6:
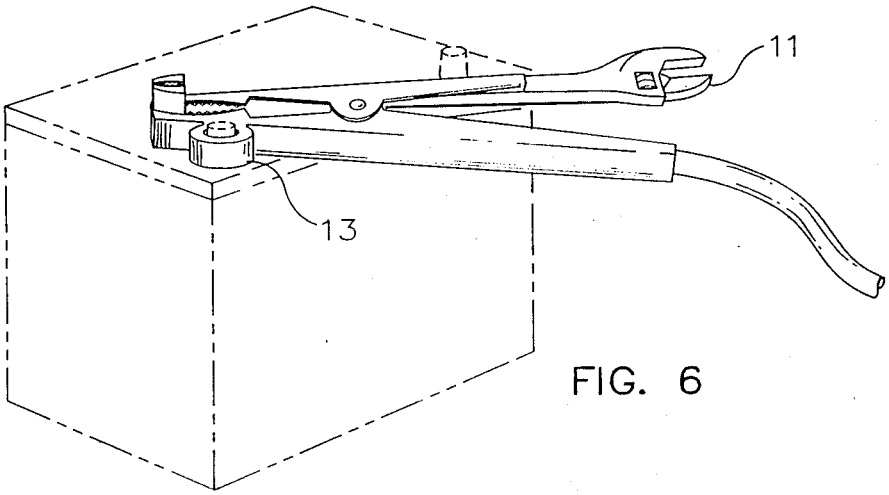
FIG. 6 shows the application of the battery terminal clamp on a battery terminal.

Referring to the plan view of the battery clamp in FIG. 1 the clamp comprises first and second elongate members 1 and 2 each having a handle 3 and 4 at respective ends thereof for gripping the clamp. The elongate members 1 and 2 pivoting around the orifices 5 and 6 and pivot pin 7. A coil spring 8 is positioned around the pin 7 including arms that extend into the handles 3 and 4 urging the clamping jaws 9 and 10 towards each other. The first elongate member 1 handle portion 3 terminates in an adjustable end wrench 11. The handle portion 4 of the second elongate member terminating in cable connecting means 12.

At the ends forward of the hinge pin 7 the elongate members have first and second concave configured jaws. The first set of jaws 15 and 16 at the terminal end of the elongate member are of a reduced size for holding hex or square headed bolts. The second jaws 9 and 10 are of a spacing suitable for grasping the battery terminal. Fastened to the outside surface of elongate member 2, opposite the clamping jaws 10, is a circular clamp fitting 13 having the corrugated inside center orifice tapered to accommodate the battery terminal.

In use the spring loaded battery clamp can be clamped to the battery terminal or it can be attached by forcing the circular clamp fitting over the terminal. The smaller clamping jaws at the end of the battery clamp can be used to grasp the standard battery terminal. The adjustable wrench can be used to grasp the terminal bolt on a standard battery terminal connector.

I claim:

1. A battery terminal clamp comprising a pair of handles hingedly connect to provide jaws at one end wherein the improvement comprises:

spring means at the hinge point tending to close the jaws together;

the jaws having sequential first and second sets of matching teeth;

the first set of teeth at the tip of the handles having a concave configuration sized for grasping the compression bolt of a standard battery terminal connector;

the second set of teeth inwardly adjacent to the first set of teeth having a concave configuration sized to grasp the battery terminal;

a first handle of the battery clamp extending back of the hinge point terminating in an adjustable end wrench;

a second handle extending back of the hinge point terminating in an electrical cable fastening means; and, a cylindrical clamp head with serrated internal radius to frictionally grasp the battery terminal is fastened to the outside surface of one of the handles opposite the second set of jaw teeth.

* * * * *